US005207077A

United States Patent [19]

Radermacher et al.

[11] Patent Number: 5,207,077

[45] Date of Patent: May 4, 1993

[54] REFRIGERATION SYSTEM

[75] Inventors: Reinhard Radermacher, Silver Spring; Dongsoo Jung, Ellicott City, both of Md.

[73] Assignee: The University of Maryland, College Park, Md.

[21] Appl. No.: 846,917

[22] Filed: Mar. 6, 1992

[51] Int. Cl.[5] ..... F25B 1/00

[52] U.S. Cl. ..... 62/502; 62/114; 252/67

[58] Field of Search ..... 62/114, 502; 252/67

[56] References Cited

U.S. PATENT DOCUMENTS 3,203,194 8/1965 Fuderer ..... 62/114
3,362,180 1/1968 Eiseman, Jr. ..... 62/114
4,416,119 11/1983 Wilson et al. ..... 62/502
4,812,250 3/1989 Ambrosino et al. ..... 62/114
5,062,985 11/1991 Takemasa ..... 62/114
5,076,064 12/1991 Kopko et al. ..... 62/114
5,080,823 1/1992 Arnaud et al. ..... 62/114
5,092,138 3/1992 Radermacher et al. ..... 62/502

*Primary Examiner*—Ronald C. Capossela
*Attorney, Agent, or Firm*—Oblon, Spivak, McClelland, Maier & Neustadt

[57] ABSTRACT

A dual evaporator refrigeration system cooling separate compartments at different temperatures employs specific combinations of environmentally safe refrigerants as working fluids. Each of the working fluids is a binary or ternary combination which yields enhanced efficiency in the dual evaporator system.

4 Claims, 1 Drawing Sheet

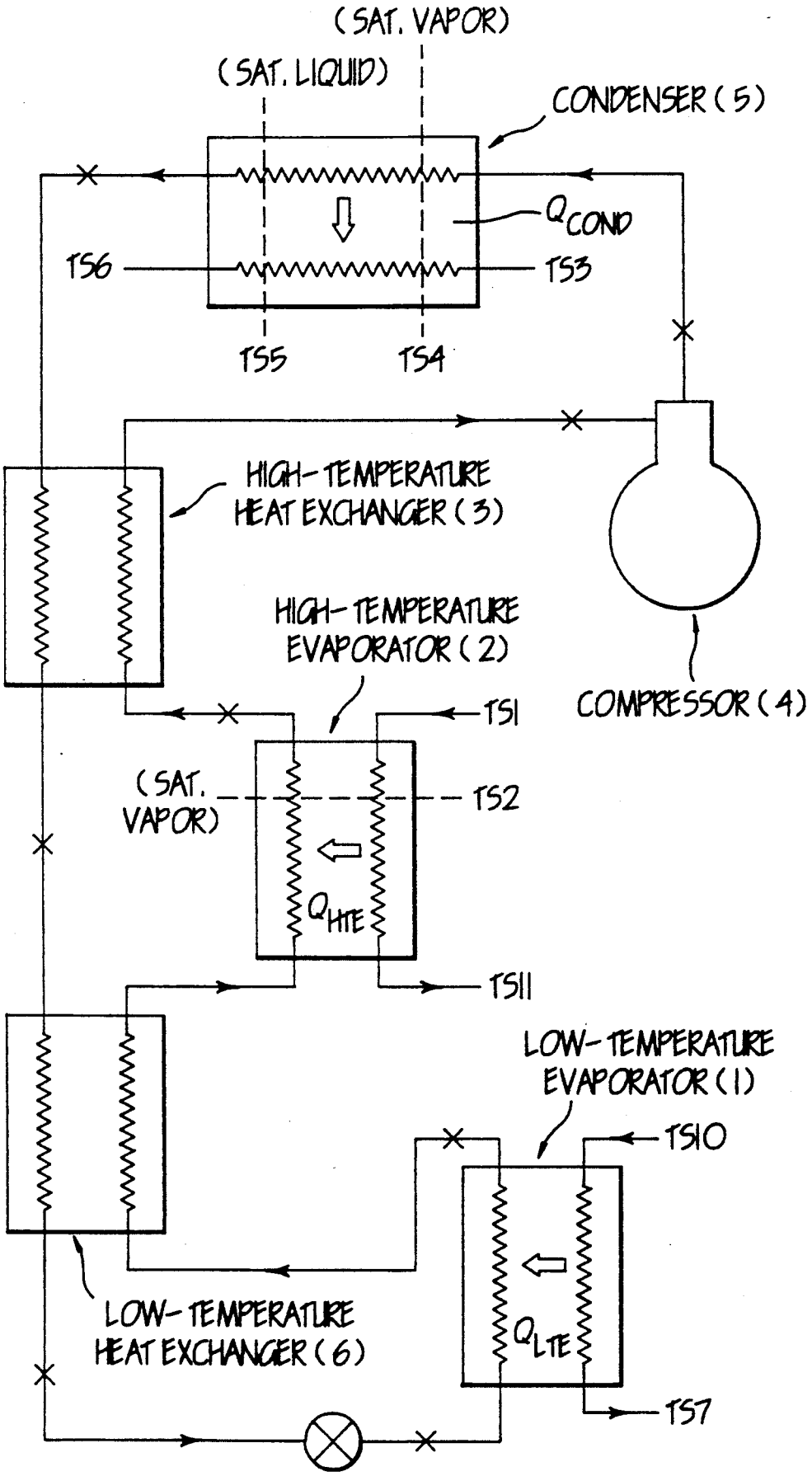
(SAT. VAPOR)
(SAT. LIQUID)
CONDENSER (5)
$Q_{COND}$
TS6
TS3
TS5
TS4
HIGH-TEMPERATURE HEAT EXCHANGER (3)
HIGH-TEMPERATURE EVAPORATOR (2)
COMPRESSOR (4)
TS1
(SAT. VAPOR)
TS2
$Q_{HTE}$
TS11
LOW-TEMPERATURE EVAPORATOR (1)
TS10
LOW-TEMPERATURE HEAT EXCHANGER (6)
$Q_{LTE}$
TS7

REFRIGERATION SYSTEM

The government of the United States may have rights in this patent pursuant to Government Contract EPA-G-R-817111-01-0.

BACKGROUND OF THE INVENTION

1. Field of the Invention

The present invention relates to a two-evaporator refrigeration system employing novel, highly efficient working fluid mixtures, designed to cool two separate compartments at different temperatures in the same device (e.g., as in a refrigerator/freezer unit). The novel working fluid mixtures of the present invention are specifically designed for a two-evaporator refrigeration system and employ environmentally safe refrigerant working fluids as components of the mixtures.

THE INVENTORS' PRIOR DEVELOPMENTS

U.S. Pat. No. 5,092,138 is directed to a dual evaporator refrigeration cycle employing any one of six specified working fluid mixtures. By providing a separate evaporator for the high-temperature cycle, and a separate evaporator for the low-temperature cycle, and employing carefully selected refrigerant mixtures, substantial efficiencies, measured as the coefficient of performance (COP) are obtained, using a working fluid of R12 as the baseline measure. While substantial reductions in energy consumption are achieved by avoiding the need to use the low-temperature evaporator to cool both the high and low-temperature compartments (e.g., refrigerator and freezer compartments), the mixtures specified in this patent are not optimized for environmental safety. Thus, the mixtures employ halocarbons which are both biologically unsafe, unsafe for release to the environment, or both. The entire disclosure of U.S. Pat. No. 5,092,138 is incorporated herein by reference.

As discussed in that patent, a variety of prior art mixtures are known, generally nonazeotropic mixtures such as R12 (dichlorodifluoromethane) and R11 (trichloromonofluoromethane). Other mixtures are set forth in U.S. Pat. No. 4,416,199, Wilson, U.S. Pat. No. 4,707,996 and U.S. Pat. No. 4,674,297, Vobach and U.S. Pat. No. 4,350,020 and U.S. Pat. No. 4,344,292, Rojey.

SUMMARY OF THE INVENTION

One object of this invention is to provide a two-evaporator refrigeration system comprising a high-temperature and a low-temperature evaporator within a single cycle as a means to efficiently maintain two separate compartments of the same device at two different temperatures, using environmentally safe working fluid mixtures.

Novel, environmentally safe refrigerant mixtures are provided as working fluid mixtures for this two-evaporator refrigeration cycle. These mixtures are not well discussed in the literature, and there is no evidence of predictability from conventional mixtures, not designed to be environmentally safe, to the environmentally safe mixtures identified herein. Experimentally, and by computer modelling, the refrigerant mixtures of the present invention have been found to be particularly useful in the twin evaporator system of the inventive cycle.

Other aspects and advantages of the refrigeration system and the novel refrigerant mixtures of the present invention are disclosed in the following descriptions of the drawing, and the preferred embodiments.

BRIEF DESCRIPTION OF THE DRAWING:

FIG. 1 is a schematic illustration of the inventive refrigeration system. In the Figure, reference characters TS1 through TS11 correspond to measurement points in the system, by which performance of the system, using different mixtures, is measured.

DETAILED DESCRIPTION OF THE DRAWING

Low-temperature evaporator 1 is connected by a conduit to high-temperature evaporator 2. From high-temperature evaporator 2, the components of the refrigerant mixture (which may or may not have the same ratio as in the low-temperature evaporator 1) flow through a conduit through high-temperature heat exchanger 3, then continue through a conduit to compressor 4. After compression, a conduit carries the components of the fluid mixture through condenser 5, where it is converted from the vapor phase to the liquid phase. The working fluid mixture flows through another conduit to high-temperature heat exchanger 3, continuing back to low-temperature evaporator 1. An optional low-temperature heat exchanger 6 can be placed in the system, such that the conduit connecting the low-temperature evaporator 2 and the conduit connecting high-temperature heat exchanger 5 to low-temperature evaporator 1 passes through the low-temperature heat exchanger 6, in heat exchange relationship.

The two-evaporator refrigeration circuit is intended for use in applications where two separate compartments of the same device are required to be kept at different temperatures. Clearly, one of ordinary skill in the art could substitute a separate, single evaporator having high and low-temperature sections divided off, in place of the two evaporators of the cycle addressed. Preferably, the circuit of the present invention is used in a refrigerator/freezer unit, wherein one compartment must be maintained at a temperature slightly above the freezing point of water, and a second compartment maintained at a temperature substantially below the freezing point of water.

The novel refrigerant mixtures to be employed as the working fluid and the refrigeration cycle of the invention have been carefully selected both to maximize performance in the dual evaporator apparatus of the system, and to be environmentally safe. Refrigerant mixtures of the claimed invention were selected on the basis of their calculated coefficient of performance, along with other pertinent data. Among preferred refrigerant mixtures are:

1. Propane and 1,1-dichloro-1-fluoroethane (R141b)
2. Propane and 1,1-dichloro-2,2,2-trifluoroethane (R123)
3. Difluoromethane (R32), 1,1-difluroethane (R152a) and (R141b)
4. R32, R152a and R123

Other mixtures, which are optimized to be environmentally safe and energy conservative include R32/R134a/R141b, R32/R134a and R123. Particular preference is made out for those combinations that employ components that are chlorinated.

Exemplary concentrations for each combination vary. In general, two component systems require that each fluid be present in ratios of 9:1–1:9. Three component systems offer greater variability, but in general, each component must be present in an amount of at least 10%, and no more than 80%. Certain preferred combinations including the following.

| COMBINATIONS | FLUIDS | WEIGHT RATIOS |
|---|---|---|
| 1 | propane/R141b | 65/35 |
| 2 | propane/R123 | 65/35 |
| 3 | R32/R152a/R141b | 15/55/30 |
| 4 | R32/R152/R123 | 15/55/30 |
| 5 | R32/R134a/R141b | 15/55/30 |
| 6 | R32/R134a/R123 | 15/55/30 |

Computer modelling of the above systems has demonstrated a sharp reduction in energy consumption, when used in the above-described two-evaporator design. Consumption was based on the AHAM standard. Experimental test results show that the identified refrigerant mixtures in two-evaporator refrigeration systems performed 14–17% better than conventional single-evaporator refrigeration systems with R12 as the working fluid. Thus, the improvements obtained through the same system are on the same order of magnitude as those set forth in U.S. Pat. No. 5,092,138, but have the added advantage of being environmentally acceptable, avoiding reliance on chlorofluorocarbons to be banned, such as R22.

Obviously, numerous modifications and variations of the invention are possible in light of the above teachings. Conventional additives or unavoidable pollutants may ultimately form part of the working fluid mixture. Means for monitoring and maintaining a desired temperature level in each of the two compartments may ultimately form part of the refrigeration system. It is therefore to be understood that within the scope of the appended claims, the invention may be practiced other than as specifically described herein.

What is claimed:

1. In a refrigeration system comprising two evaporators, a heat exchanger, a compressor and a condenser all in fluid communication through which a working fluid is circulated, the improvement being wherein said working fluid consists essentially of a mixture of environmentally safe working fluids, said mixture being selected from the group consisting of propane/R141b, propane/R123, R32/R152a/R141b, R32/R152a/R123, R32/R134a/R141b and R32/R134a/R123.

2. The system of claim 1, wherein said system further comprises a second heat exchanger.

3. The system of claim 1, wherein said mixture is a two-component mixture, and said two components are present in a weight ratio of 9:1–1:9.

4. The system of claim 1, wherein said working mixture is a three-component mixture, and each component is present in an amount of 10–80% by weight.

* * * * *